US007347157B2

(12) United States Patent
Seiple

(10) Patent No.: US 7,347,157 B2
(45) **Date of Patent: *Mar. 25, 2008**

(54) STATIC SOFT RAIL LAUNCH AND RECOVERY SYSTEM

(76) Inventor: Ronald L Seiple, 1063 Koohoo Pl., Kailua, HI (US) 96734

( * ) Notice: Subject to any disclaimer, the term of this patent is extended or adjusted under 35 U.S.C. 154(b) by 0 days.

This patent is subject to a terminal disclaimer.

(21) Appl. No.: 11/647,211

(22) Filed: Dec. 29, 2006

(65) Prior Publication Data

US 2007/0245945 A1 Oct. 25, 2007

Related U.S. Application Data

(63) Continuation-in-part of application No. 11/409,000, filed on Apr. 24, 2006, now Pat. No. 7,156,036.

(51) Int. Cl.
*B63B 21/00* (2006.01)

(52) U.S. Cl. ..... 114/230.2; 405/1

(58) Field of Classification Search ..... 405/1; 114/230.2; 440/34; 212/87
See application file for complete search history.

(56) References Cited

U.S. PATENT DOCUMENTS 2,564,951 A * 8/1951 Blagden
3,094,222 A * 6/1963 McAllister ..... 212/87
3,838,657 A * 10/1974 Fleming ..... 114/230.22
4,211,513 A * 7/1980 Hosie
4,300,854 A * 11/1981 Sluys
4,745,873 A * 5/1988 Mott
5,066,033 A * 11/1991 Kolstad et al.
5,154,564 A * 10/1992 Koch
5,215,405 A 6/1993 Hogan
5,400,733 A 3/1995 Richter
5,511,928 A 4/1996 Ellis
6,182,597 B1 2/2001 Maxwell et al.
6,341,793 B2 1/2002 Braum
6,408,778 B1 * 6/2002 Wood, II ..... 114/230.22

(Continued)

FOREIGN PATENT DOCUMENTS

FR 2 862 921 * 6/2005

OTHER PUBLICATIONS http://www.roodberg.com/eng/marine/slip/towed.php "Hydraulic Boat Trailer" retrieved on Jul. 28, 2006.*

(Continued)

*Primary Examiner*—Stephen Avila
(74) *Attorney, Agent, or Firm*—Richard C. Litman

(57) ABSTRACT

The static soft rail launch and recovery system provides an anchor or piling located in a body of water away from the shoreline. The anchor remains at a fixed point under water, while being attached to cables having their opposite ends affixed on land to tension the cables. The cables become like rails due to static tension between the two fixed points. The watercraft is placed on a sling carriage that is slidably mounted on the cables and capable of sliding down the cables to launch the watercraft into the water. The watercraft is recovered by a winch cable tied to the watercraft and connected to a recovery winch. The system may be modified to use a single tow cable, attached to an anchor or piling. The system is used to launch watercraft of various sizes, and other payloads, and may be deployed for military, commercial, or emergency missions.

8 Claims, 4 Drawing Sheets

U.S. PATENT DOCUMENTS

| | | | |
|---|---|---|---|
| 6,827,033 | B2 | 12/2004 | Ockels |
| 2005/0173892 | A1* | 8/2005 | Terminello |
| 2006/0022430 | A1* | 2/2006 | Pate |

OTHER PUBLICATIONS http://www.autow.co.uk/trailers/snipe.html "Snipe Boat Trailers" retrieved on Jul. 28, 2006.*

* cited by examiner

STATIC SOFT RAIL LAUNCH AND RECOVERY SYSTEM

CROSS-REFERENCE TO RELATED APPLICATION

This application is a Continuation-In-Part of U.S. patent application Ser. No. 11/409,000, "Launch and Recovery System", filed Apr. 24, 2006, which is hereby incorporated by reference in its entirety.

BACKGROUND OF THE INVENTION

1. Field of the Invention

The present invention relates to launching and recovering watercraft, and particularly to a static soft rail launch and recovery system for launching watercraft from, and recovering the watercraft to, a land-based launch area.

2. Description of the Related Art

The use of land-based boat launch systems is known in the prior art. More specifically, boat launch systems heretofore devised and utilized are known to consist basically of familiar, expected and obvious structural configurations, notwithstanding the myriad of designs encompassed by the crowded prior art, which have been developed for the fulfillment of countless objectives and requirements.

For example, a known prior art device is described in French Patent No. 2,862,921, published Jun. 3, 2005. The '921 patent discloses bringing a boat opposite to a floating carriage constituted by an axle with two wheels, then using a motor on the boat returning the carriage assembly and boat to shore. From the drawings in Thierry, it is evident that the carriage is a boat trailer that is used for the recovery process of the boat.

None of the above inventions and patents, taken either singly or in combination, is seen to describe the instant invention as claimed. Thus, a static soft rail launch and recovery system solving the aforementioned problems is desired.

SUMMARY OF THE INVENTION

The static soft rail launch and recovery system provides an anchor or piling that is deployed in a body of water away from the shoreline. The anchor remains in place at a fixed point underwater, while being attached to cables having their opposite ends affixed on land to thereby place tension on the cables. The cables become stiff due to static tension applied mechanically between the two fixed points, so that the cables take on the character of rails. The boat, watercraft, or other payload to be launched is placed on a sling carriage that is slidably mounted on the cables, so that the sling slides down the cables, launching the watercraft into the water between the shoreline and the anchor point. The watercraft is recovered by tying a winch cable or line to the watercraft, winching the watercraft back onto the sling, and winching the sling back onto the launching area on shore.

The system may be modified to use a single tow cable attached to an anchor or piling. The launch and recovery system may be used to launch manned craft of various sizes, unmanned undersea vessels, mine hunting vehicles, emergency rescue craft, and other types of payload. The system may be deployed for military purposes, for commercial enterprises, and for emergency rescue work for cruise ships, fishing trawlers, merchant ships, and the like.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1A:
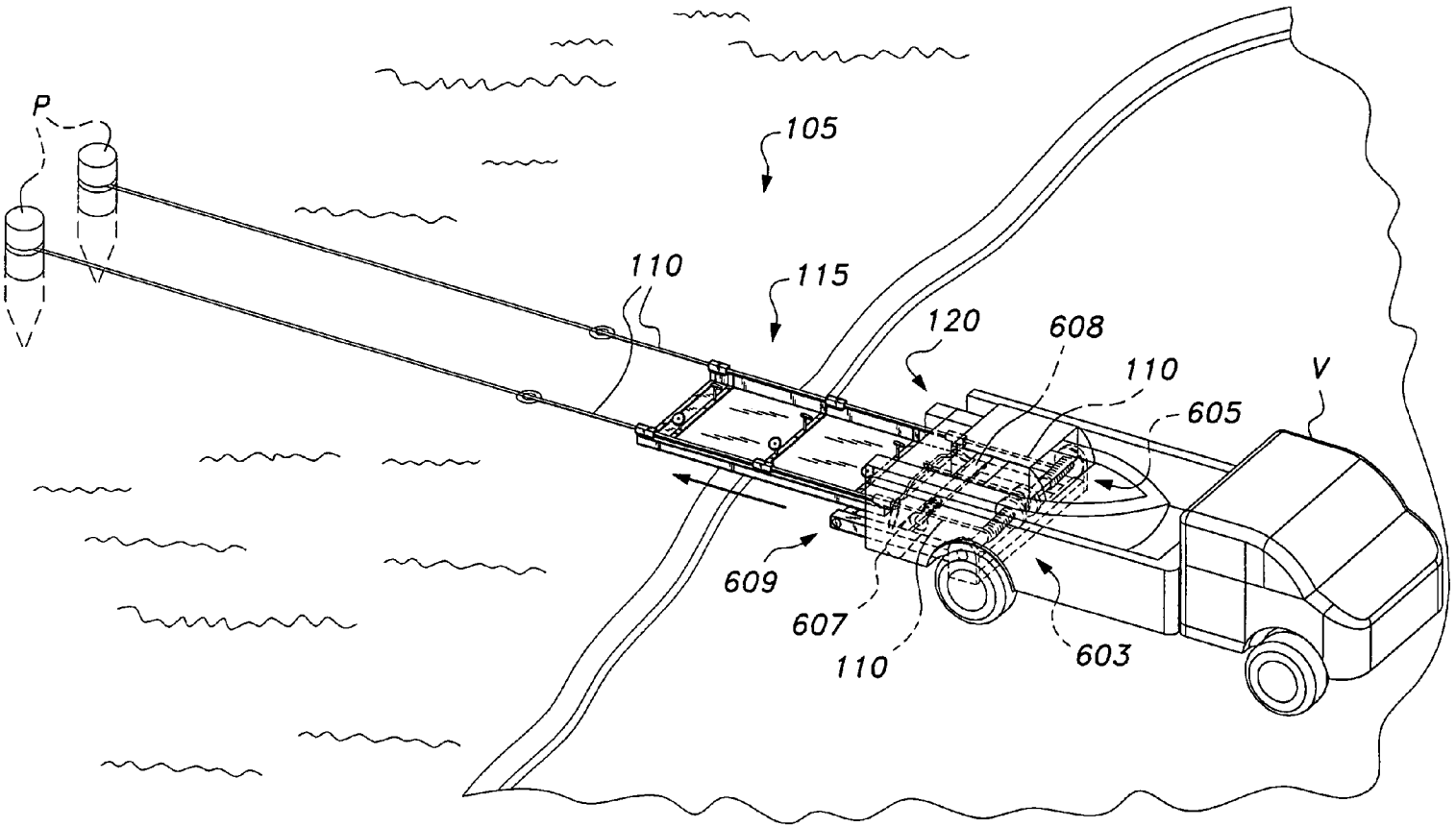
FIG. 1A is an environmental, perspective view of a static soft rail launch and recovery system according to the present invention, showing a boat in a prelaunch position on a transporting vehicle.
Figure 1B:
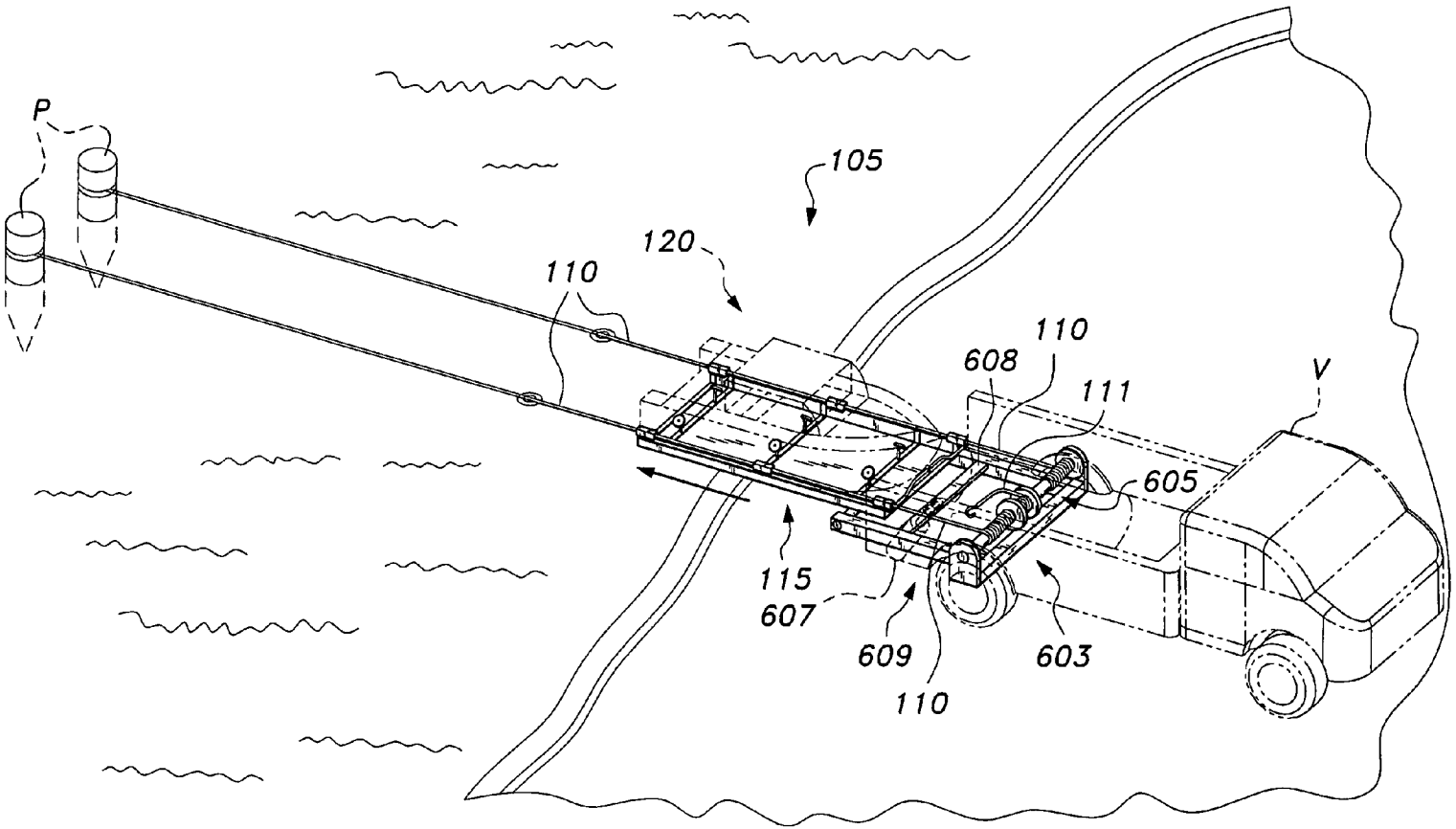
FIG. 1B is an environmental, perspective view of the static soft rail launch and recovery system according to the present invention, showing the boat in a prelaunch position on the sling carriage.
Figure 1C:
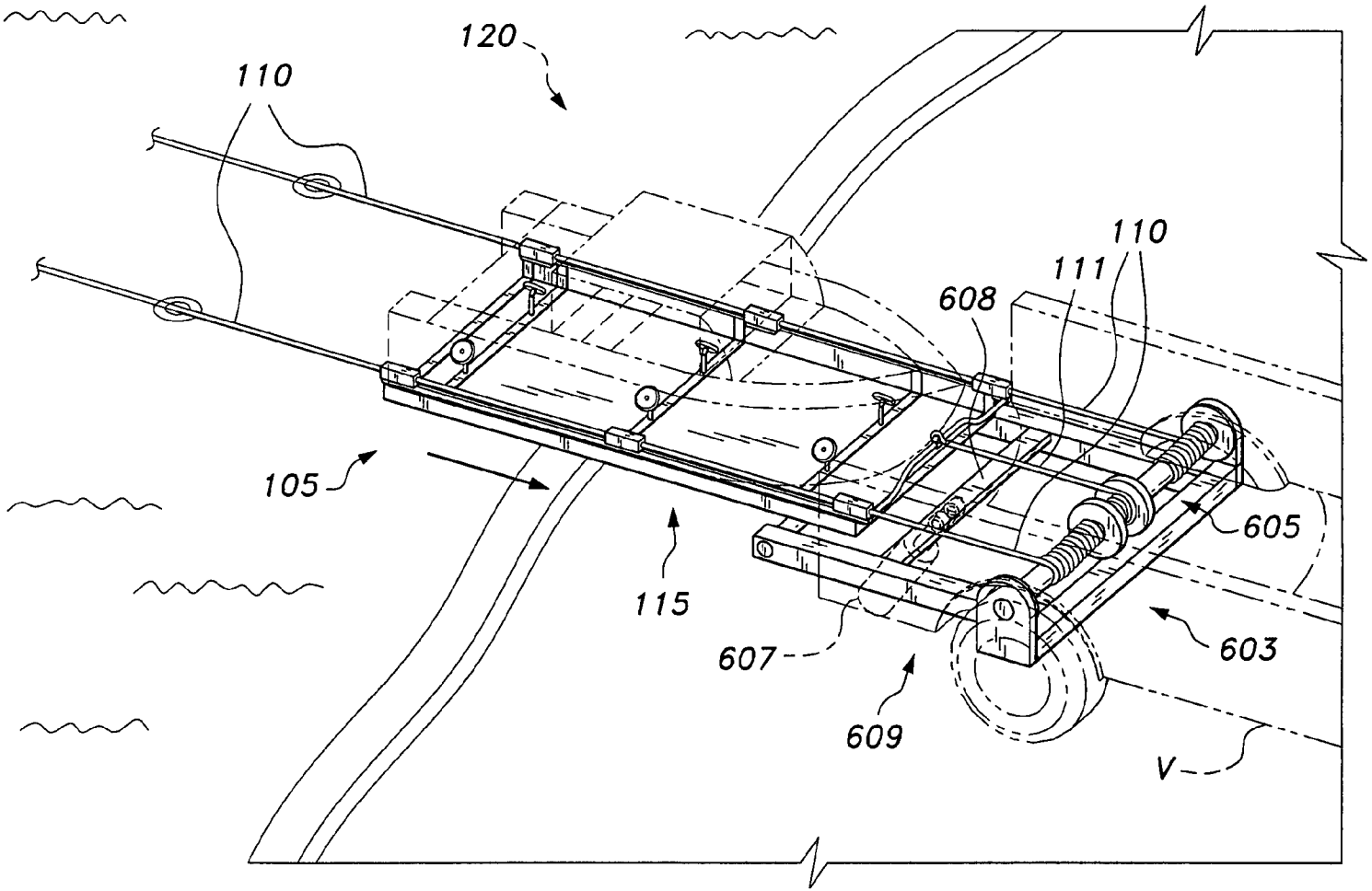
FIG. 1C is an environmental, perspective view of the static soft rail launch and recovery system according to the present invention, showing the boat and sling carriage in a recovery position.

The present invention, as shown in FIGS. 1A-1C, is a launch and recovery system, designated generally as 105 in the drawings. An anchor or piling P is deployed in a body of water away from the shoreline. The anchor/piling P remains in place at a fixed point under water, while being attached to cables 110 having their opposite ends affixed to a land-based launch site assembly 603 to thereby place tension on the cables 110. The cables 110 become stiff due to static tension applied mechanically between the fixed point at piling P and the fixed point at land-based launch site 603, so that the cables 110 under tension have rail-like properties. At the land-based launch site assembly 603, the cables 110 may be independently attached to a split drum winch 605 that can be used to properly tension the cables 110. At least one hydraulic ram 607 can be attached to a transfer mechanism, such as lateral cross member 608 of pivoting payload tilt frame 609.

The watercraft 120 or other payload can be transported to the launch site 603 by vehicle V. The vehicle V carrying watercraft 120 is lined up over winch assembly 605 and stationary members of tilt mechanism 609. The sling carriage 115 can be temporarily attached to a rear portion of vehicle V to provide stability of the system 105 during transfer of the boat 120 from the vehicle V to the sling carriage 115. The watercraft 120 is guided over transfer rollers 807 disposed on the sling carriage 115 until the watercraft 120 is secured to sling carriage 115. Temporary attachment of the carrier sling 115 to the vehicle V can be removed.

The tilt mechanism 609 can then be tilted slightly upward by activating piston of hydraulic ram 607 to pivot the tilt mechanism about frame members holding winch assembly 605. Tilting action of tilt mechanism 609 engages front end of the sling carriage 115 to tilt the carriage 115 away from the land surface and towards the water. During the launch operation, the winches 603 may be adjusted to provide the proper degree of tautness to the soft rails 110. When a desired tilt angle has been achieved, the sling carriage 115 and payload begin to gather speed while sliding backward on the soft rails 110 towards the water until the carriage 115 and boat 120 hit the water. According to the present invention, launch site assembly 603 may be a permanent fixture, or on a mobile platform, or an assembly that can be erected and broken down on any type of terrain.

When the boat, watercraft, or other payload 120 to be launched is placed on, and secured to, the sling carriage 115 (the sling carriage 115 being slidably mounted on the cables 110), the sling carriage 115 can slide down the cables 110 in order to launch the watercraft/payload 120 into the water between the shoreline and the anchor point P. The watercraft 120 is recovered by tying a winch cable or line 111 to the watercraft, winching the watercraft 120 back onto the sling carriage 115, and winching the sling carriage 115 and its payload 120 back onto the launching area 603 on shore.

The system may be modified to use a single tow cable, i.e., one soft rail 110, which can be attached between the anchor or piling P and the land based launch site 603. The launch and recovery system may be used to launch manned craft of various sizes, unmanned undersea vessels, mine hunting vehicles, emergency rescue craft, and other types of payload. The system may be deployed for military purposes, for commercial enterprises, and for emergency rescue work for cruise ships, fishing trawlers, merchant ships, and the like.

The cables 110 are preferably one to two inches in diameter, and may be composed of strands of a durable synthetic polymer, e.g., nylon. Each cable 110 may be custom designed to withstand suitable tensions for any given payload. Braided ropes are preferable because of their resistance to twisting. Synthetic ropes with low elastic elongation do not have severe snap reaction when broken under high loads, enhancing the safety of the launch. Each of these ropes can be easily spliced by experienced personnel at the launch site 603.

Higher strength synthetic ropes have nearly twenty years of working history in fishing fleets and have properties of high strength, high abrasion resistance and low weight, and thus are preferable for use as cables 110. In particular, the high molecular weight polyethylene ropes marketed under the trade names of Spectra® and Dynema® are suitable for use in the launch and recovery system 105.

Typical rope properties for use as cables 110 preferably include an ultrahigh molecular weight (UHMW) polyethylene composition having a specific gravity of 0.98, a percent stretch at 30%, a break load of 0.96%, a diameter of fifty-two millimeters, a breaking strength of 186,000 kg, and a weight per length of 162 kg/100 m.

Alternatively, the cables 110 may be composed of flexible and resilient stranded wire having similar properties to the aforementioned. A payload to line tension ratio may range up to approximately 0.35. The angle of attack of the cables 110 with respect to the water may range from approximately 30° (scope ratio of 2:1) for the steepest angle to approximately 5° (scope ratio of 11:1) for a shallower angle.

Figure 2:
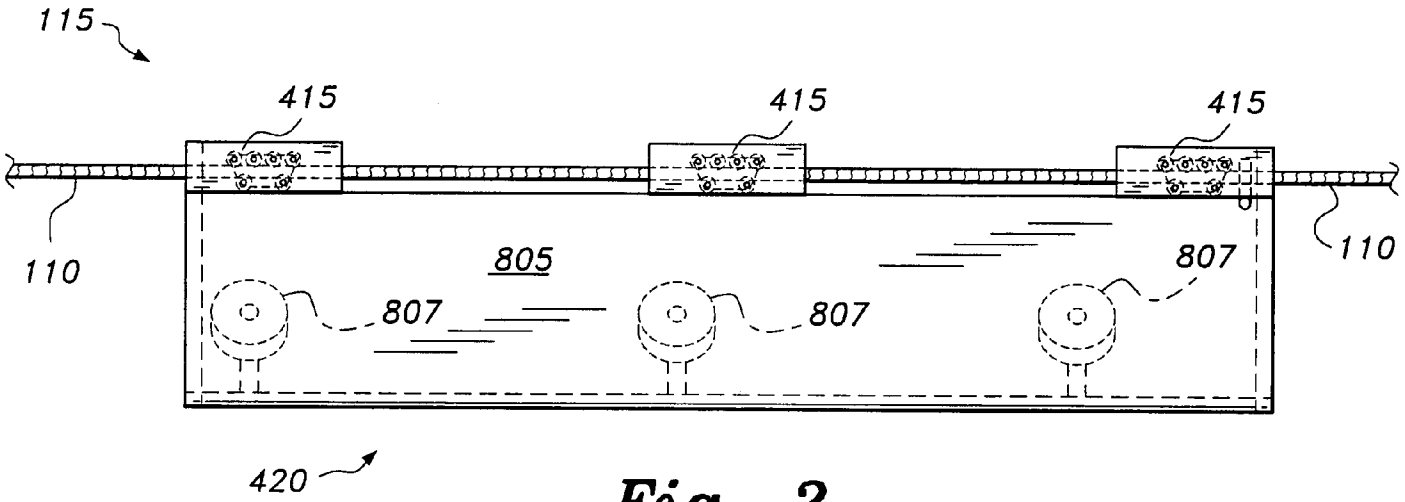
FIG. 2 is a side view of the launch sling in a static soft rail launch and recovery system according to the present invention.
Figure 3:
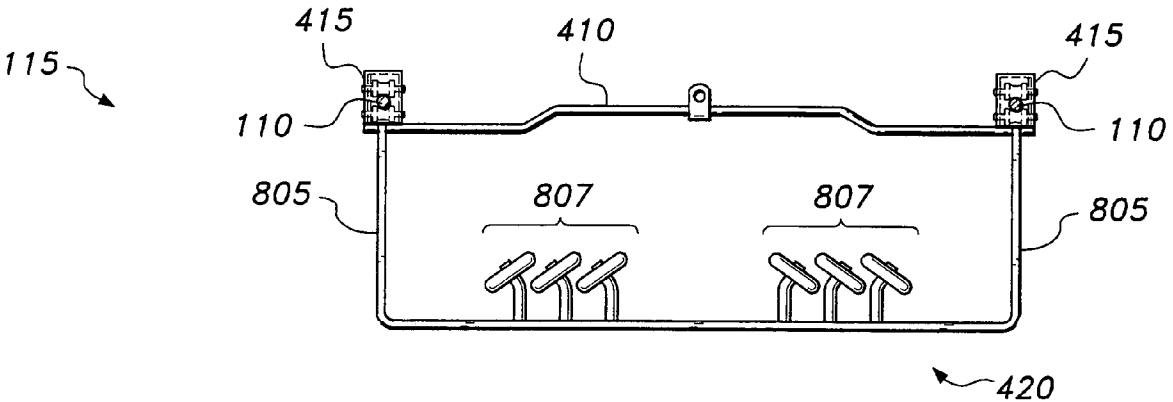
FIG. 3 is a rear view of the launch sling in a static soft rail launch and recovery system according to the present invention.

The watercraft 120, or other payload, is held on the cables 110 by the sling carriage 115, which is removably attached to, and is capable of riding on, the taut cables 110. As shown in FIGS. 1C, 2, and 3, the sling carriage 115 includes resilient, or alternatively, rigid longitudinal sidewalls 805, anterior alignment bar 410, and a netted or strapped bottom structure 420 that holds the watercraft 120 by friction between the netted structure 420 and the watercraft 120. Guide rollers 415 having slide bores form a removable attachment to the cables 110, and are disposed at predetermined longitudinal intervals along the upper edge of the sling carriage 115.

Optionally, rows of slanting hull rollers 807 may be disposed on opposing lateral sides along the bottom of the sling carriage 115. The watercraft 120 can be held in place by the slanting hull rollers 807. Deployment of the watercraft 120 is achieved by releasing the sling carriage 115, which carries the watercraft 120 along the cables 110 and into the water away from the launch site assembly 603. Additionally, the hull rollers assist separation of the watercraft 120 from the sling carriage 115.

During deployment, the sling carriage 115 continues underwater where it reaches stops disposed on the cables 110. Thus, the watercraft 120 is automatically free of the sling carriage 115 when the watercraft 120 hits the water, thereby completing the launch process.

According to the present invention, when the payload drop is from four meters above the water, payload trajectory speed may range from approximately twenty meters per second to approximately twelve meters per second, depending upon the payload weight, which may range from under 1,000 kg to over 20,000 kg.

Recovery of the watercraft 120 from the water is accomplished by capturing a ball and recovery line 111 that is passed through a guide in the alignment bar 410 of sling carriage 115 and allowed to play out thirty to fifty feet beyond the sling carriage. The end of line 111 may be attached to a buoy. The crew of the watercraft 120 can retrieve the end of the line 111 from the buoy and secure the captured line to the bow of watercraft 120 at a tow hook (not shown). Winch 605 may have an independent central drum and motor recovery winch attached to recovery line 111 through recovery line pulley 602 that can pull in the watercraft while aligning the watercraft 120 with the sling carriage 115 by means of the guide in alignment bar 410. The watercraft is pulled back aboard the sling carriage 115, and line 111 is winched to pull both sling carriage 115 and watercraft 120 back to the launch site 103.

It is within the scope of the present invention that the various aforementioned dimensions and performance limitations of elements of the launch recovery system 105 may be modified by using simulation and analysis software such as, for example, the Numerical Engineering and Modeling of Ocean Systems (NEMOS) published at Illinois Institute of Technology (IIT).

Other modeling software allowing for dynamic and nonlinear element formulation, large deformations, fluid loading that includes the capability to simulate superimposed waves, current gradient, current shear, and having the capability to subject elements to pressure, wave and current loading may be utilized.

It is to be understood that the present invention is not limited to the embodiment described above, but encompasses any and all embodiments within the scope of the following claims.

I claim:

1. A static soft rail launch and recovery system, comprising:

a land-based launch site;

a fixed tie-off structure disposed in a body of water;

at least one cable statically attached to the land-based launch point, a free end of the at least one cable being attached to the fixed tie-off structure in the body of water; and a sling carriage slidably mounted on the at least one cable, the sling carriage being adapted for carrying a payload; said land-based launch site including a lifting actuator and a pivoting transfer mechanism, the lifting actuator being attached to the pivoting transfer mechanism, the pivoting transfer mechanism being responsive to the lifting actuator to pivot the sling carriage into a launch position;

wherein the at least one cable extending between the land based launch site and the fixed tie-off structure provides sufficient tension to the at least one cable for sliding the sling carriage down the cable to launch the payload from the land based site to the body of water.

2. The static launch soft rail and recovery system according to claim 1, further comprising a recovery winch adapted for mounting at the launch site, the recovery winch having a recovery line attached to the sliding carriage, whereby the sliding carriage is retrieved after launch by operation of the recovery winch, and the sliding carriage and a watercraft mounted thereon are retrieved after use by operation of the recovery winch.

3. The static soft rail launch and recovery system according to claim 1, wherein said sliding carriage further comprises a plurality of guide rollers attached thereto, the guide rollers being slidably disposed on said at least one cable.

4. A static soft rail launch and recovery system, comprising;

a land-based launch site;

a fixed tie-off structure disposed in a body of water;

at least one cable statically attached to the land-based point, a free end of the at least one cable being attached to the fixed tie-off structure in the body of water; and a sling carriage slidably mounted on the at least one cable, the sling carriage being adapted for carrying a payload, wherein said sliding further comprises a plurality of hull rollers attached thereto, the hull rollers being disposed at an angle to roll against the hull of a watercraft in order to assist watercraft separation from the sliding carriage when the watercraft hits the water during launch.

5. The static soft rail launch and recovery system according to claim 1, wherein said fixed tie-off structure comprises at least one anchor.

6. The static soft rail launch and recovery system according to claim 1, wherein said fixed tie-off structure comprises at least one piling.

7. The static soft rail launch and recovery system according to claim 1, wherein said at least one cable has a diameter of between about one to two inches, is formed from braided strands of a durable synthetic polymer, and has sufficient strength to withstand a tension of up to about 26,000 kg.

8. The static soft rail launch and recovery system according to claim 1, wherein said at least one cable comprises a pair of cables adapted for attachment to a split drum winch.

* * * * *